US007926411B2

(12) United States Patent
Nishikawa et al.

(10) Patent No.: US 7,926,411 B2
(45) Date of Patent: Apr. 19, 2011

(54) VALVE CONTROL UNIT

(75) Inventors: Hiroyasu Nishikawa, Tokyo (JP); Sei Shimahara, Tokyo (JP); Manabu Nakanishi, Hyogo (JP)

(73) Assignee: Caterpillar S.A.R.L., Geneva (CH)

( * ) Notice: Subject to any disclaimer, the term of this patent is extended or adjusted under 35 U.S.C. 154(b) by 413 days.

(21) Appl. No.: 11/997,332

(22) PCT Filed: Feb. 20, 2007

(86) PCT No.: PCT/JP2007/053025

§ 371 (c)(1),
(2), (4) Date: Jan. 30, 2008

(87) PCT Pub. No.: WO2008/001511

PCT Pub. Date: Jan. 3, 2008

(65) Prior Publication Data

US 2009/0114298 A1 May 7, 2009

(30) Foreign Application Priority Data

Jun. 29, 2006 (JP) ..... 2006-180097

(51) Int. Cl.
*F15B 11/00* (2006.01)

(52) U.S. Cl. ..... 91/515; 60/422; 137/596.16

(58) Field of Classification Search ..... 137/596.16; 60/422; 91/515

See application file for complete search history.

(56) References Cited

U.S. PATENT DOCUMENTS

| | | | | |
|---|---|---|---|---|
| 4,534,268 | A * | 8/1985 | Yagyu et al. | 91/6 |
| 6,393,838 | B1 * | 5/2002 | Moriya et al. | 60/422 |
| 6,761,027 | B2 * | 7/2004 | A'Hearn et al. | 60/327 |
| 6,810,663 | B2 * | 11/2004 | Konishi et al. | 60/421 |
| 2003/0150210 | A1 * | 8/2003 | Shimada | 60/484 |
| 2006/0147315 | A1 * | 7/2006 | Jang et al. | 417/213 |

FOREIGN PATENT DOCUMENTS

| | | |
|---|---|---|
| JP | 10072850 | 3/1998 |
| JP | 11303807 | 11/1999 |
| JP | 2000096629 | 4/2000 |
| JP | 2000309950 | 11/2000 |
| JP | 2003232305 | 8/2003 |
| WO | 02086331 | 10/2002 |

* cited by examiner

*Primary Examiner* — Craig M Schneider

(74) *Attorney, Agent, or Firm* — McDermott Will & Emery LLP

(57) ABSTRACT

A valve control unit that prevents a decline in interlocking operation performance when pilot pressure control of a plurality of pilot-operated control valves is carried out by proportional solenoid valves. First and second proportional solenoid valves include a Common Operation Table of lever operation amount/boom-up pilot pressure characteristics and are inputted with a common boom-up lever operation amount. A third proportional solenoid valve also includes the Operation Table and is inputted with a stick-in lever operation amount common to the fourth proportional solenoid valve. The fourth proportional solenoid valve includes an Operation Table of lever operation amount/stick-in pilot pressure characteristics different from that of the first, second, and third proportional solenoid valves and is inputted with the stick-in lever operation amount common to the third proportional solenoid valve.

1 Claim, 4 Drawing Sheets

PRIOR ART

PRIOR ART

VALVE CONTROL UNIT

This is a U.S. national phase application under 35 U.S.C. §371 of International Patent Application No. PCT/JP2007/053025 filed Feb. 20, 2007, and claims the benefit of Japanese Application No. 2006-180097, filed Jun. 29, 2006. The International Application has not yet been published as of the time of this application. However, the contents of both applications are incorporated herein in their entireties.

TECHNICAL FIELD

The present invention relates to a valve control unit that controls the pilot pressure of a pilot-operated control valve by a proportional solenoid valve.

BACKGROUND ART

As shown in FIG. 2, for a hydraulic excavator 1 serving as a work machine, an upper structure 3 is rotatably provided on a lower structure 2, on this upper structure 3, mounted is an operating unit 5 with a cab 4, and for this operating unit 5, pivotally supported on the upper structure 3 is a boom 6 to be pivoted in the up-and-down direction by a boom cylinder 6*c*, pivotally supported on a front end of this boom 6 is a stick 7 to be pivoted in the in/out direction by a stick cylinder 7*c*, and pivotally supported on a front end of this stick 7 is a bucket 8 to be pivoted by a bucket cylinder 8*c*.

The boom cylinder 6*c* and the stick cylinder 7*c* are controlled by spool-type pilot-operated control valves, and respective pilot-operated control valves for the boom and stick are provided two each so that the operation speed, that is, flow rate, of each cylinder can be sufficiently secured (see Japanese Laid-Open Patent Publication No. 2003-232305 (e.g., Page 5, FIG. 1) for example).

In such a control valve circuit, when a horizontal dragging work is carried out while the front end of the bucket 8 is kept touching the ground, it is necessary to devise so that an interlocking operation between boom up and stick in can be smoothly carried out (see Japanese Laid-Open Patent Publication No. 2000-96629 (e.g., Pages 5-6, FIG. 1), for example).

FIG. 3 shows a valve control unit of a conventional hydraulic control work machine that directly controls the pilot pressure of a pilot-operated spool valve by a remote control valve.

That is, a first boom spool valve 11 is stroke-controlled by a boom-up pilot pressure Pa and a boom-down pilot pressure Pb, and a first stick spool valve 12 is stroke-controlled by a stick-in pilot pressure Pc and a stick-out pilot pressure Pd, while a second boom spool valve 13 for securing a boom-up flow rate is stroke-controlled by the boom-up pilot pressure Pa and the stick-in pilot pressure Pc.

Although the second boom spool valve 13 feeds hydraulic oil to a head side of the boom cylinder 6*c*, for an interlocking operation with a stick-in motion, it is necessary to suppress the boom-up speed, the stick-in pilot pressure Pc against the boom-up pilot pressure Pa is made to act on the second boom spool valve 13.

The boom-up pilot pressure Pa is a pilot pressure outputted from a remote control valve 14, and the stick-in pilot pressure Pc is a pilot pressure outputted from a remote control valve 15, however, Operation Table Characteristics 16 of these control valves 14 and 15, that is, lever operation angle/pilot pressure characteristics, of these remote control valves are identical.

Thus, in the case of a hydraulic control type, since the operation table characteristics (relationship between the lever operation angle and pilot pressure for spool displacement control) are the same for every motion, control balance of the second boom spool valve 13 is maintained, and an interlocking operation between boom up and stick in can also be smoothly carried out.

Where this is applied to a valve control unit of an electrical control work machine that controls pilot pressures Pa, Pc, and the like by proportional solenoid valves 21 to 24, only when an Operation Table 25 of the proportional solenoid valves 21 and 22 are made identical to an Operation Table 26 of the proportional solenoid valves 23 and 24, the control balance of the second boom spool valve 13 is maintained, and the interlocking motions are smoothly carried out as shown in FIG. 4, however, in this electrical control hydraulic excavator shown in FIG. 4, the Operation Tables 25 and 26 for respective motions can be separately set so as to determine optimal operability in any situation.

SUMMARY OF THE INVENTION

In such case, the characteristics contents are different between the Boom-Up Operation Table 25 and the Stick-In Operation Table 26, the control balance of the second boom spool valve 13 maintained in the case of FIG. 3 is lost, and interlocking operation performance for stick in and boom up declines.

The present invention has been made in view of such a problem, and an object thereof is to provide a valve control unit that can prevent a decline in interlocking operation performance when pilot pressure control of a plurality of pilot-operated control valves is carried out by proportional solenoid valves.

The invention relates to a valve control unit including: a first pilot-operated control valve that controls a first fluid pressure actuator; a second pilot-operated control valve that controls a second fluid pressure actuator; a third pilot-operated control valve that controls the first fluid pressure actuator in conjunction with the first pilot-operated control valve; a first proportional solenoid valve that controls a pilot pressure that acts on one side of the first pilot-operated control valve relative to a manual operation amount; a second proportional solenoid valve that controls a pilot pressure that acts on one side of the third pilot-operated control valve relative to a manual operation amount; a third proportional solenoid valve that controls a pilot pressure that acts on the other side of the third pilot-operated control valve relative to a manual operation amount; and a fourth proportional solenoid valve that controls a pilot pressure that acts on the other side of the second pilot-operated control valve relative to a manual operation amount, wherein the first and second proportional solenoid valves have common manual operation amount/pilot pressure characteristics and are inputted with a common manual operation amount, the third proportional solenoid valve has manual operation amount/pilot pressure characteristics common to the first and second proportional solenoid valves and is inputted with a manual operation amount common to the fourth proportional solenoid valve, and the fourth proportional solenoid valve has manual operation amount/pilot pressure characteristics different from those of the first, second, and third proportional solenoid valves and is inputted with the manual operation amount common to the third proportional solenoid valve.

The invention as set forth below, as set forth above, wherein the first fluid pressure actuator is a boom cylinder that pivots a boom of a hydraulic excavator in an up-and-down direction, the second fluid pressure actuator is a stick cylinder that pivots a stick pivotally supported on a front end of the boom in an in/out direction, the first and second proportional solenoid valves have lever operation amount/boom-up pilot pressure characteristics and are inputted with a common boom-up lever operation amount, the third proportional solenoid valve has lever operation amount/boom-up pilot pressure characteristics common to the first and second proportional solenoid valves and is inputted with a stick-in lever operation amount common to the fourth proportional solenoid valve, and the fourth proportional solenoid valve has lever operation amount/stick-in pilot pressure characteristics different from those of the first, second, and third proportional solenoid valves and is inputted with the stick-in lever operation amount common to the third proportional solenoid valve.

According to the invention, although the third proportional solenoid valve is inputted with the manual operation amount common to the fourth proportional solenoid valve, since the third proportional solenoid valve has the manual operation amount/pilot pressure characteristics common to the first and second proportional solenoid valves, control balance of the third pilot-operated control valve can be maintained to secure predetermined operability, whereby a decline in interlocking operation performance when pilot pressure control of a plurality of pilot-operated control valves is carried out by proportional solenoid valves can be prevented.

According to the invention as set forth, although the third proportional solenoid valve is inputted with the stick-in lever operation amount common to the fourth proportional solenoid valve, since the third proportional solenoid valve has the lever operation amount/boom-up pilot pressure characteristics common to the first and second proportional solenoid valves, even when these lever operation amount/boom-up pilot pressure characteristics are different from the lever operation amount of the fourth proportional solenoid valve/stick-in pilot pressure characteristics, control balance of the third pilot-operated control valve can be maintained to secure interlocking operation performance for stick-in and boom up.

DETAILED DESCRIPTION OF THE INVENTION

Hereinafter, the present invention will be described in detail while referring to an embodiment shown in FIG. 1 and a hydraulic excavator 1 serving as a work machine shown in FIG. 2.

Figure 2:
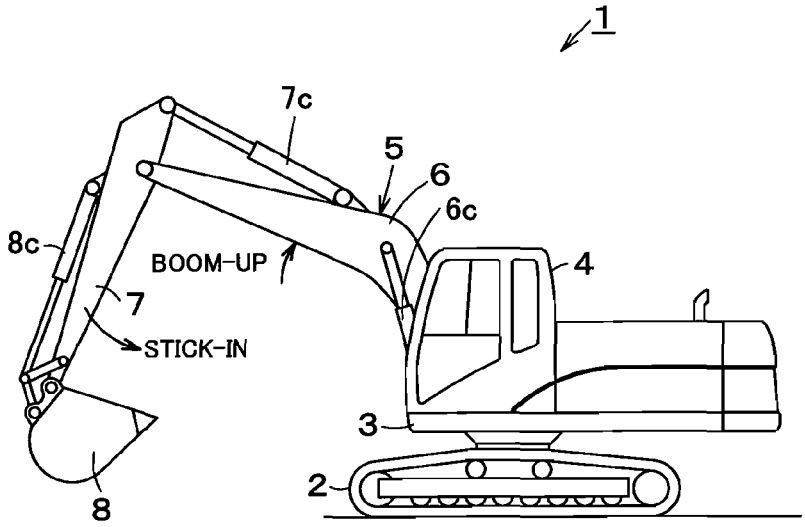
FIG. 2 A side view of a work machine mounted with the same valve control unit as above.
Figure 3:
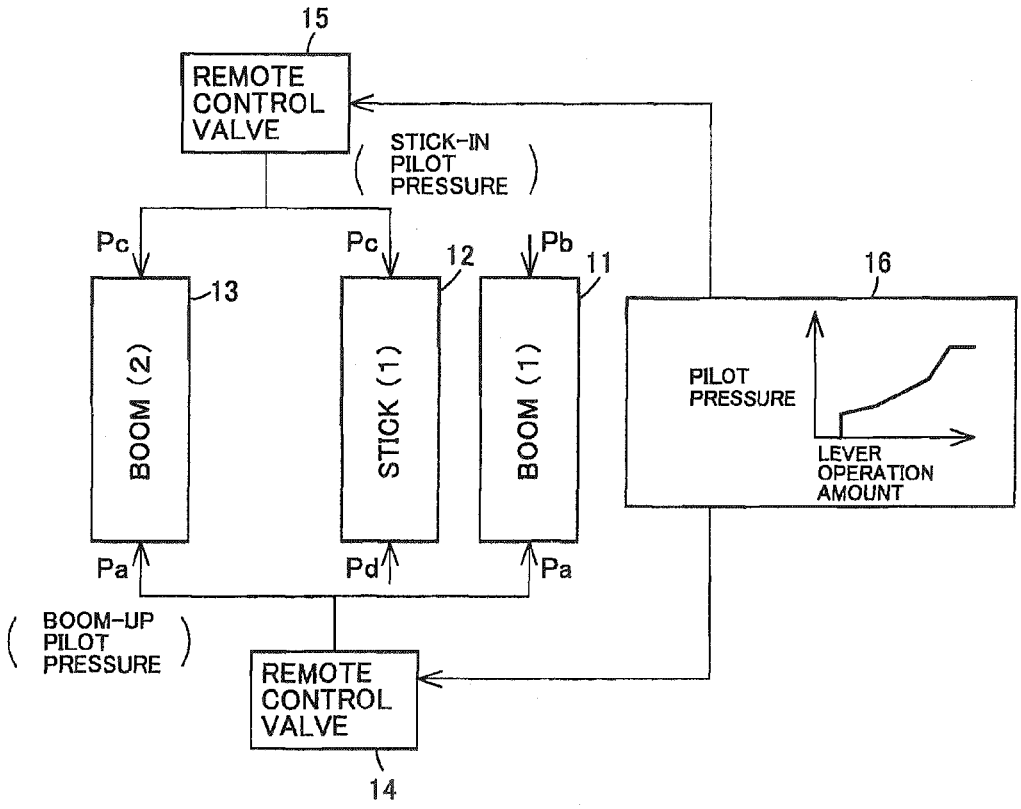
FIG. 3 A block diagram showing a valve control unit of a conventional hydraulic control work machine.
Figure 4:
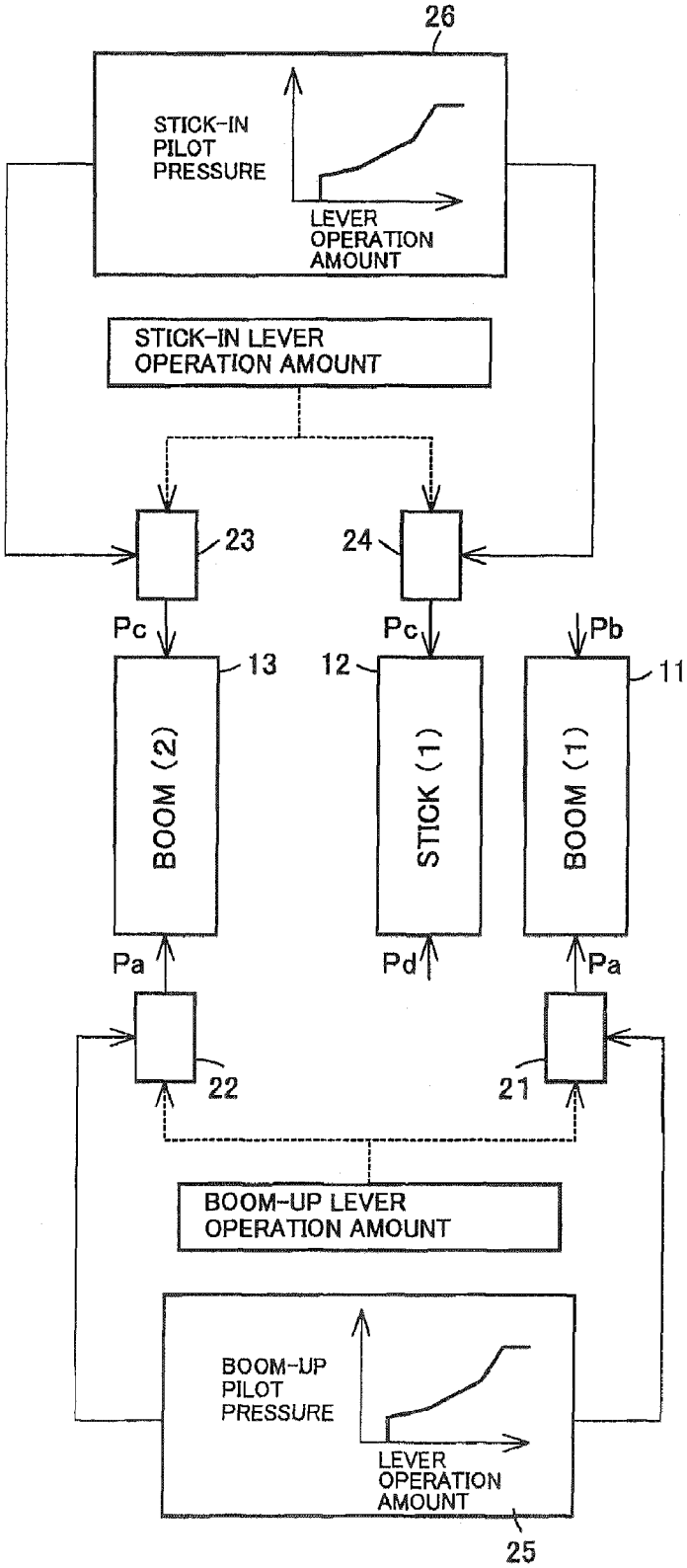
FIG. 4 A block diagram showing a valve control unit of a conventional electrical control work machine.

As shown in FIG. 2, a boom cylinder 6*c* serving as a first fluid pressure actuator is a hydraulic cylinder that pivots a boom 6 of the hydraulic excavator in the up-and-down direction, and a stick cylinder 7*c* serving as a second fluid pressure actuator is a hydraulic cylinder that pivots a stick 7 pivotally supported on a front end of the boom 6 in the in/out direction. Here, explanation of other parts of the hydraulic excavator 1 will be omitted.

Figure 1:
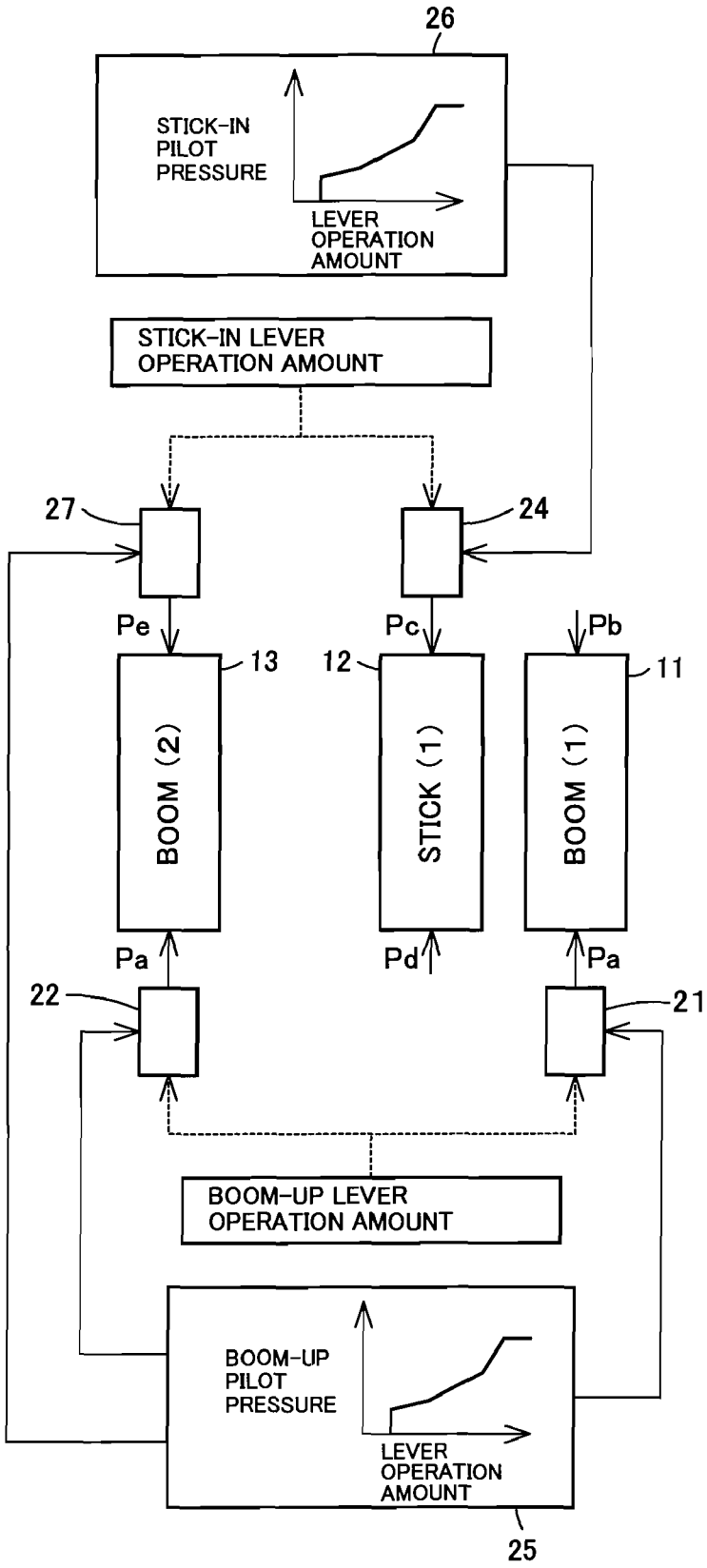
FIG. 1 A block diagram showing an embodiment of a valve control unit according to the present invention.

In FIG. 1, shown is a part of a control valve mounted on the hydraulic excavator 1, and this control valve includes a first boom spool valve 11 serving as a first pilot-operated control valve to control the boom cylinder 6*c*, a first stick spool valve 12 serving as a second pilot-operated control valve to control the stick cylinder 7*c*, and a second boom spool valve 13 serving as a third pilot-operated control valve to control the boom cylinder 6*c* in conjunction with the first boom spool valve 11.

The control valve includes, besides these spool valves, a second stick spool valve (not shown) to control the stick cylinder 7*c* in conjunction with the first spool valve 12, a bucket spool valve (not shown) to control a bucket cylinder 8*c*, and the like.

In pilot lines of these spool valves, installed are a first proportional solenoid valve 21 to control a boom-up pilot pressure Pa that acts on one side of the first boom spool valve 11 relative to a boom-up lever operation amount as a manual operation amount, a second proportional solenoid valve 22 to control a boom-up pilot pressure Pa that acts on one side of the second boom spool valve 13 relative to the boom-up lever operation amount, a third proportional solenoid valve 27 to control an anti-boom-up pilot pressure Pe that acts on the other side of the second boom spool valve 13 relative to a stick-in lever operation amount as a manual operation amount, and a fourth proportional solenoid valve 24 to control a stick-in pilot pressure Pc that acts on the other side of the first stick spool valve 12 relative to the stick-in lever operation amount.

A boom-down pilot pressure Pb that acts on the other side of the first boom spool valve 11 and a stick-out pilot pressure Pd that acts on one side of the first stick spool valve 12 are controlled by unillustrated proportional solenoid valves.

The first and second proportional solenoid valves 21 and 22 include a Common Operation Table 25 of lever operation amount/boom-up pilot pressure characteristics and are inputted with a common boom-up lever operation amount.

The third proportional solenoid valve 27 includes the Operation Table 25 of lever operation amount/boom-up pilot pressure characteristics common to the first and second proportional solenoid valves 21 and 22 and is inputted with a stick-in lever operation amount common to the fourth proportional solenoid valve 24.

The fourth proportional solenoid valve 24 includes an Operation Table 26 of lever operation amount/stick-in pilot pressure characteristics different from that of the first, second, and third proportional solenoid valves 21, 22, and 27 and is inputted with the stick-in lever operation amount common to the third proportional solenoid valve 27.

The Operation Tables 25 and 26 are incorporated in the form of numerical expressions or mappings within a controller (not shown) that arithmetically processes the lever operation amounts inputted by electrical signals and controls the proportional solenoid valves 21, 22, 27, and 24.

Next, actions and effects of this embodiment will be described.

For example, when a horizontal dragging work is carried out while the front end of a bucket 8 is kept touching the ground, since it is necessary to carry out an interlocking operation between a boom-up motion and a stick-in motion, by satisfactorily maintaining control balance of the second spool valve 13 on whose one side the boom-up pilot pressure Pa acts and on whose other side the anti-boom-up pilot pressure Pe acts, the boom-up speed is suppressed according to the stick-in lever operation amounts so that an interlocking operation between boom up and stick in can be smoothly carried out.

In such case, although the Operation Table 25 for boom up and the Operation Table 26 for stick in have been separately set so as to determine optimal operability, since the Common Operation Table 25 is used for characteristics of the pilot pressures that act on one and the other sides of the second boom spool valve 13 and operation table characteristics (relationship between the lever operation amount and pilot pressure for spool displacement control) for the stick-in motion and boom-up motion are the same, the control balance of the second spool valve 13 can be satisfactorily maintained.

Thus, although the third proportional solenoid valve 27 is inputted with the stick-in lever operation amount common to the fourth proportional solenoid valve 24, since the third proportional solenoid valve 27 includes the Operation Table 25 of lever operation amount/boom-up pilot pressure characteristics common to the first and second proportional solenoid valves 21 and 22, control balance of the second boom spool valve 13 can be satisfactorily maintained to secure interlocking operation performance for stick in and boom up, whereby a decline in interlocking operation performance when pilot pressure control of a plurality of pilot-operated control valves is carried out by proportional solenoid valves can be prevented.

That is, since the Operation Table 25 for boom up controls the anti-boom-up pilot pressure Pe that controls the second boom spool valve 13 while using a stick-in lever stroke for the lever operation amount, even when the Stick-In Operation Table 26 and the Boom-Up Operation Table 25 are different, control balance of the second boom spool valve 13 can be satisfactorily maintained to secure interlocking operation performance for stick-in and boom up.

Here, the present method is applied to only to the time of an interlocking operation.

The present invention can be applied to, for example, a work machine such as a hydraulic excavator.

The invention claimed is:

1. A valve control unit comprising:

a first pilot-operated control valve that controls a first fluid pressure actuator wherein the first fluid pressure actuator is a boom cylinder that pivots a boom of a hydraulic excavator in an up-and-down direction;

a second pilot-operated control valve that controls a second fluid pressure actuator wherein the second fluid pressure actuator is a stick cylinder that pivots a stick pivotally supported on a front end of the boom in an in/out direction;

a third pilot-operated control valve that controls the first fluid pressure actuator in conjunction with the first pilot-operated control valve;

a first proportional solenoid valve that controls a pilot pressure that acts on one side of the first pilot-operated control valve relative to a manual operation amount;

a second proportional solenoid valve that controls a pilot pressure that acts on one side of the third pilot-operated control valve relative to a manual operation amount;

a third proportional solenoid valve that controls a pilot pressure that acts on a side, which is opposite to the side on which the pilot pressure generated by the second proportional solenoid valve acts, of the third pilot-operated control valve relative to a manual operation amount; and a fourth proportional solenoid valve that controls a pilot pressure that acts on a side of the second pilot-operated control valve relative to a manual operation amount, wherein the first and second proportional solenoid valves have common manual operation amount/pilot pressure characteristics and are inputted with a common manual operation amount, the first and second proportional solenoid valves have common lever operation amount/boom-up pilot pressure characteristics and are inputted with a common boom-up lever operation amount, the third proportional solenoid valve has manual operation amount/pilot pressure characteristics common to the first and second proportional solenoid valves and is inputted with a manual operation amount common to the fourth proportional solenoid valve, the third proportional solenoid valve has lever operation amount/boom-up pilot pressure characteristics common to the first and second proportional solenoid valves and is inputted with a stick-in lever operation amount common to the fourth proportional solenoid valve, the fourth proportional solenoid valve has manual operation amount/pilot pressure characteristics different from those of the first, second, and third proportional solenoid valves and is inputted with the manual operation amount common to the third proportional solenoid valve, and the fourth proportional solenoid valve has lever operation amount/stick-in pilot pressure characteristics different from those of the first, second, and third proportional solenoid valves and is inputted with the stick-in lever operation amount common to the third proportional solenoid valve.

* * * * *